US010293201B2

(12) United States Patent
Tomellini et al.

(10) Patent No.: US 10,293,201 B2
(45) Date of Patent: May 21, 2019

(54) FITNESS TRAINING BAGS

(71) Applicants: Dalita Tomellini, Rehoboth, MA (US); Melinda Penney, Providence, RI (US); Phillip Brooks, Franklin, MA (US); Lindsay Pettinelli, Providence, RI (US)

(72) Inventors: Dalita Tomellini, Rehoboth, MA (US); Melinda Penney, Providence, RI (US); Phillip Brooks, Franklin, MA (US); Lindsay Pettinelli, Providence, RI (US)

(73) Assignee: LINDON GROUP, INC., East Providence, RI (US)

( * ) Notice: Subject to any disclaimer, the term of this patent is extended or adjusted under 35 U.S.C. 154(b) by 17 days.

(21) Appl. No.: 15/304,748

(22) PCT Filed: Apr. 15, 2015

(86) PCT No.: PCT/US2015/026024
§ 371 (c)(1),
(2) Date: Oct. 17, 2016

(87) PCT Pub. No.: WO2015/160989
PCT Pub. Date: Oct. 22, 2015

(65) Prior Publication Data

US 2017/0036056 A1 Feb. 9, 2017

Related U.S. Application Data

(60) Provisional application No. 61/981,038, filed on Apr. 17, 2014.

(51) Int. Cl.
*A63B 21/00* (2006.01)
*A63B 21/06* (2006.01)
(Continued)

(52) U.S. Cl.
CPC ..... *A63B 21/0601* (2013.01); *A63B 21/028* (2013.01); *A63B 21/0603* (2013.01);
(Continued)

(58) Field of Classification Search
CPC ..... A63B 21/0601; A63B 21/0602; A63B 21/0603; A63B 21/0604; A63B 69/34;
(Continued)

(56) References Cited

U.S. PATENT DOCUMENTS 5,417,635 A * 5/1995 Sell ..... A63B 21/0605 482/105
5,546,707 A * 8/1996 Caruso ..... A63B 63/004 52/2.13
(Continued)

FOREIGN PATENT DOCUMENTS

CN 2309867 Y 3/1999
CN 202070110 U 12/2011
(Continued)

OTHER PUBLICATIONS

Supplementary European Search Report dated Oct. 9, 2017, issued in 15 78 0608.
(Continued)

*Primary Examiner* — Nyca T Nguyen
(74) *Attorney, Agent, or Firm* — Carter, DeLuca & Farrell LLP

(57) ABSTRACT

A fitness training bag provided in accordance with aspects of the present disclosure includes a body having an outer bag, and inner bag, and a filler. The outer bag encloses a first interior area therein and is water-permeable. The inner bag is disposed within the first interior area, encloses a second interior area therein, and is also water-permeable. The filler is disposed within second interior area and includes a plurality of pieces of material that are non-absorbent, drain-
(Continued)

able, and non-packable. At least some of the plurality of pieces of material are resiliently compressible so as to be shock-absorbing. At least one handle is stitched to the body. The at least one handle is configured to facilitate manipulation of the body to perform an exercise.

20 Claims, 7 Drawing Sheets

(51) Int. Cl.
*A63B 21/02* (2006.01)
*A63B 21/072* (2006.01)
*A63B 21/075* (2006.01)

(52) U.S. Cl.
CPC ..... *A63B 21/072* (2013.01); *A63B 21/075* (2013.01); *A63B 21/4035* (2015.10); *A63B 21/4043* (2015.10)

(58) Field of Classification Search
CPC ... A63B 69/345; A63B 21/06–21/0607; A63B 69/20–69/24
See application file for complete search history.

(56) References Cited

U.S. PATENT DOCUMENTS 6,217,489 B1 4/2001 Nicholson
6,241,637 B1 * 6/2001 Basyuk ..... A63B 23/16 482/44
6,261,210 B1 7/2001 Lishejkov et al.
6,301,722 B1 * 10/2001 Nickerson ..... A41D 13/015 2/22
8,276,351 B1 10/2012 Henkin
D672,414 S * 12/2012 Januszek ..... D21/680
8,771,152 B1 * 7/2014 Silverman ..... A63B 69/20 482/88
2010/0022361 A1 * 1/2010 Raines ..... A63B 21/06 482/93
2012/0021857 A1 * 1/2012 Raymond ..... A63B 41/08 473/603
2013/0157815 A1 6/2013 Reynolds et al.

FOREIGN PATENT DOCUMENTS

EP 1501611 B1 3/2008
EP 2520341 A1 11/2012
WO 03092823 A1 11/2003

OTHER PUBLICATIONS

International Search Report dated Jul. 3, 2015, issued in PCT/US2015/026024.

* cited by examiner

FITNESS TRAINING BAGS

CROSS-REFERENCE TO RELATED APPLICATIONS

This application claims the benefit of, and priority to, U.S. Provisional Patent Application No. 61/981,038, filed on Apr. 17, 2014, the entire contents of which are hereby incorporated herein by reference.

BACKGROUND

Technical Field

The present disclosure relates to exercise and fitness equipment and, more particularly, to fitness training bags.

Background of Related Art

Fitness training bags are known in the art for use during the course of a workout or training session. In particular, fitness training bags are lifted, carried, manipulated, thrown, and/or dropped in various ways for exercise and fitness purposes. Currently, fitness training bags take the form of a sewn sack filled with sand. Typically, the empty sacks are sold to the consumer, who then fills the sack with sand to a desired weight.

Sand-filled sacks are disadvantageous for numerous reasons. For example, due the fine particulate nature of sand, sand has a tendency to leak out of the sack after repeated use and normal wear and tear on the sack, especially during outdoor use when subject to adverse weather conditions and UV light. As can be appreciated, the leaking sand leaves behind a mess and alters the weight of the sack.

Another disadvantage of sand-filled sacks is that sand is water-absorbent, which can significantly increase the weight of the sack should water or moisture penetrate the sack. As such, sand-filled sacks are limited to indoor use or must be carefully monitored to avoid contact with water and moisture when used outdoors. In an attempt to inhibit water and moisture penetration, some sacks are formed from more solid materials. However, should water and/or moisture penetrate the more solid material and be absorbed by the sand, the solid material acts to trap that water and/or moisture within the sack. Thus, drying the sand within the sack becomes exceedingly difficult and may result in mold and mildew buildup within the sack.

Further still, sand-filled sacks are relatively stiff and lack shock-absorbing properties. As such, lifting, carrying, manipulating, throwing, and/or dropping the sack may be awkward and/or uncomfortable for the user.

Accordingly, there is a continuing for a weather-proof, durable, versatile, shock-absorbing, and comfortable fitness training bag to facilitate a user's workout or training session. Environmental friendliness, both in manufacture and use, is also desired.

SUMMARY

To the extent consistent, any of the aspects described herein may be used in conjunction with any of the other aspects described herein.

In accordance with aspects of the present disclosure, a fitness training bag is provided. The fitness training bag includes a body and at least one handle. The body includes an outer bag, an inner bag, and a filler. The outer bag encloses a first interior area therein and is water-permeable. The inner bag is disposed within the first interior area and encloses a second interior area therein. The inner bag is also water-permeable. The filler is disposed within the second interior area, the filler including a plurality of pieces of material that are non-absorbent, drainable, and non-packable. At least some of the plurality of pieces of material are resiliently compressible so as to be shock-absorbing. The at least one handle is stitched to the body and configured to facilitate manipulation of the body to perform an exercise.

In an aspect of the present disclosure, the outer bag is formed from a woven polyethylene cloth.

In another aspect of the present disclosure, the inner bag is formed from a non-woven polypropylene or polyethylene material.

In yet another aspect of the present disclosure, the filler is formed from pieces of rubber. In such aspects, the pieces of rubber may be recycled scrap material from other manufacturing processes, e.g., the manufacture of shoe soles. Additionally or alternatively, the pieces of rubber may define different densities.

In still another aspect of the present disclosure, the filler is formed from pieces of rubber mixed with plastic pellets.

In still yet another aspect of the present disclosure, first and second handles are stitched to the body. In such aspects, the first and second handles may be spaced-apart along the body a distance between 16 inches and 36 inches. More specifically, the first and second handles may be spaced-apart along the body a distance between 22 and 30 inches or, still more particularly, a distance of 26 inches.

In another aspect of the present disclosure, the at least one handle defines a looped configuration having an aperture of between 3 and 9 inches in diameter.

In still another aspect of the present disclosure, the at least one handle includes first and second ends stitched to the body at spaced-apart positions along the body.

In yet another aspect of the present disclosure, an intermediate bag is disposed between the inner and outer bags. The intermediate bag is configured to provide additional cushioning to the body.

A fitness training set provided in accordance with the present disclosure includes a plurality of fitness training bags, e.g., similar to any other aspects detailed above or any of the other aspects detailed herein. Each of the fitness training bags includes a different filler or a different amount of filler such that each of the fitness training bags defines a different weight.

In an aspect of the present disclosure, two or more of the fitness training bags are configured for use in tandem with one another.

In another aspect the fitness training set according to claim 14, wherein the outer bag is formed from a woven polyethylene cloth and the inner bag is formed from a non-woven polypropylene or polyethylene material.

BRIEF DESCRIPTION OF THE DRAWINGS

Various aspects and features of the present disclosure are described hereinbelow with reference to the drawings wherein like reference numerals identify similar or identical elements.

DETAILED DESCRIPTION

Figure 1:
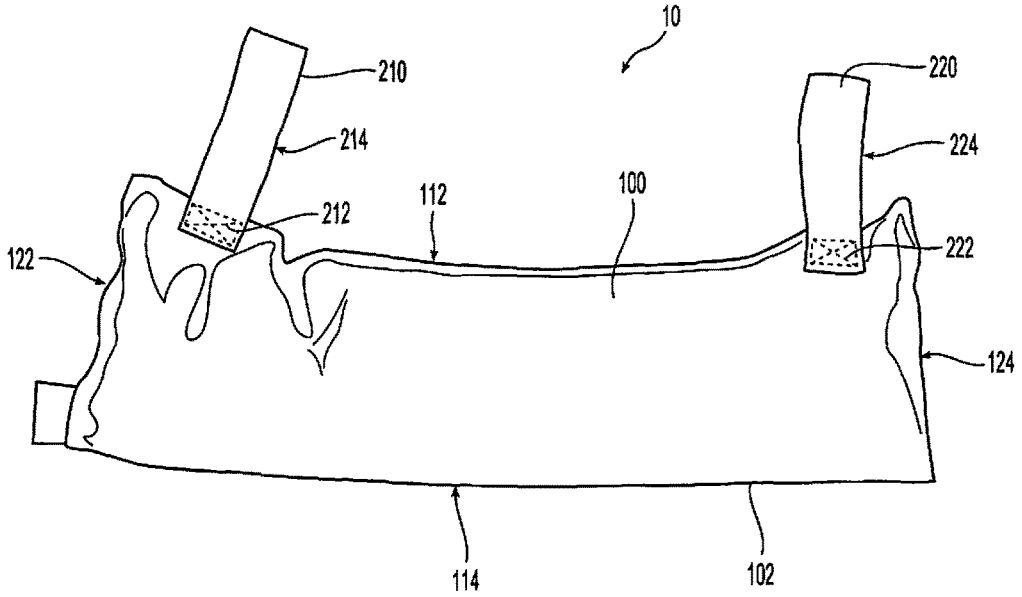
FIG. 1 is a perspective view of a fitness training bag provided in accordance with the present disclosure.
Figure 2:
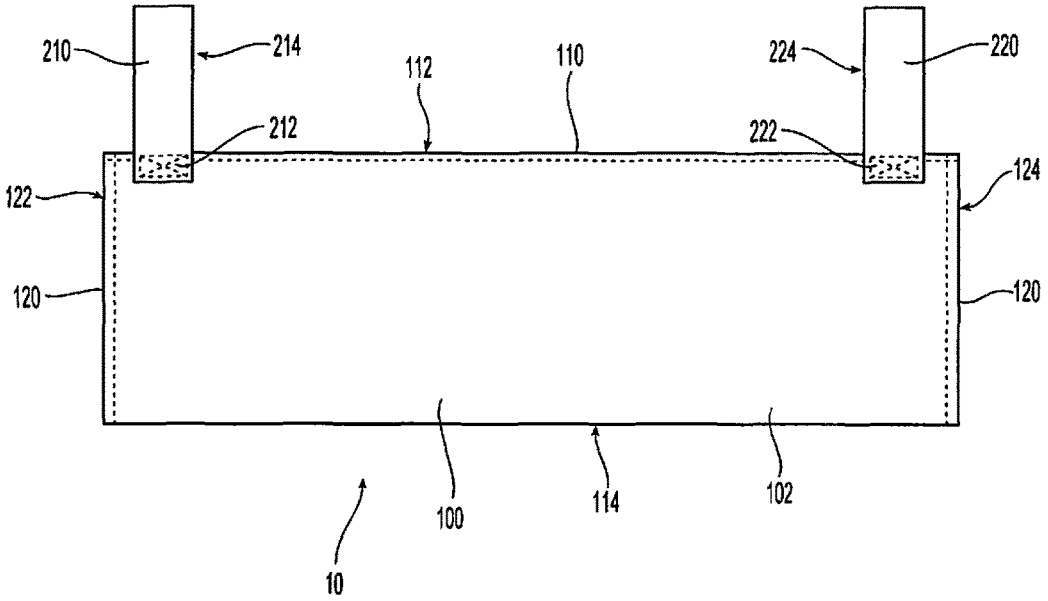
FIG. 2 is a side view of the fitness training bag of FIG. 1.

Turning to FIGS. 1 and 2, a fitness training bag provided in accordance with the present disclosure is shown generally identified by reference numeral 10. Fitness training bag 10 generally includes a body 100 having first and second handles 210, 220 engaged to body 100 and extending therefrom.

Body 100 of fitness training bag 10 includes an outer bag 102 formed from a generally rectangular sheet of material having a pair of opposed long edges 110 and a pair of opposed short edges 120. During manufacture, the sheet of material forming outer bag 102 is bent back upon itself to align the long edges 110 thereof, thus enabling the long edges 110 to be sewn together along an upper portion 112 of outer bag 102, while the bend in the sheet of material defines the lower portion 114 of outer bag 102. As a result of bending back the sheet of material forming outer bag 102 in the above-detailed manner, short edges 120 are bent in half, thus enabling the opposed halves of each of the short edges 120 to be sewn together to define end portions 122, 124 of outer bag 102 and fully enclose an interior area "$A_1$" (FIG. 4A) within outer bag 102. As fully formed, outer bag 102 defines a generally tubular configuration, although other configurations are also contemplated.

With continued reference to FIGS. 1 and 2, the sheet of material forming outer bag 102 may be a woven polyethylene cloth. Woven polyethylene cloth is advantageous in that it is strong, durable, weather-proof, water and mildew resistant, easy to clean, non-water absorbent, drainable, and resists UV-degradation. Other suitable materials for forming the sheet of material of outer bag 102 are also contemplated including, but not limited to, woven nylon from 400 to 1,000 denier (both coated and non-coated), polyethylene/nylon blends, vinyl (both coated and non-coated), imitation leather, leather, etc. As can be appreciated, these materials define relatively smooth, non-abrasive surfaces to inhibit catching and/or scratching during use of fitness training bag 10.

Body 100 of fitness training bag 10 may define various different sizes, depending upon a particular purpose, e.g., the size and/or strength of the user, the exercises to be performed, etc. More specifically, it is contemplated that multiple fitness training bags 10 of different sizes and weights be provided for various different users and/or purposes, for example:

- an extra small bag having a length of between 5 and 26 inches and a height of between 5 and 9 inches;
- a small bag having a length of between 26 and 46 inches and a diameter of between 11 and 13 inches;
- a medium bag having a length of between 32 and 52 inches and a diameter of between 13 and 15 inches;
- a large bag having a length of between 32 and 52 inches and a diameter of between 15 and 17 inches;
- an extra large bag having a length of between 34 and 54 inches and a diameter of between 17 and 19 inches;
- an extra long bag having a length of between 54 and 96 inches and a diameter of between 14 and 17 inches.

Other size bags are also contemplated. Further, each of the fitness training bags 10 may define a weight of between 1 and 200 lbs. More specifically, the set of fitness training bags 10 may define a range of weights in equal or varied increments, and/or multiple fitness training bags 10 in each size may be provided, each having a different weight (due to different internal configurations thereof, as detailed below).

Referring still to FIGS. 1 and 2, first and second handles 210, 220 are engaged to upper portion 112 of outer bag 102 of body 100 and extend therefrom, although it is envisioned that greater or fewer handles, and/or handles of different configuration may also be provided. In some embodiments, handles need not be provided. First and second handles 210, 220 are sewn to upper portion 112 of outer bag 102 using a reinforced stitching pattern to ensure a secure engagement therebetween. First and second handles 210, 220 define looped configurations wherein the ends 212, 222 thereof are sewn to upper portion 112 of outer bag 102 to define a loop opening 214, 224 within each handle 210, 220. Openings 214, 224 are configured for receipt of a user's fingers, hand, and/or arm, to facilitate lifting, carrying, manipulating, throwing, and/or dropping fitness training bag 10. More specifically, openings 214, 224 may each define a diameter between 3 inches and 9 inches. In some embodiments, openings 214, 224 are sufficiently large so as to receive the body of another fitness training bag therein, as will be detailed below with respect to FIG. 3E, and/or the handle of another fitness training bag, as will be detailed below with respect to FIG. 3F.

Handles 210, 220 are spaced-apart from one another a distance between 16 inches and 36 inches, more specifically, between 22 inches and 30 includes, or, even more particularly, 26 inches. It has been found that 26 inches is the target ergonomic spacing of handles 210, 220 for the average person to grasp fitness training bag 10 with arms at shoulder-width apart; however, other distances within the above-noted ranges may alternatively be provided, depending upon the size and/or preference of the user or for a particular purpose. Further, other configurations of handles are also contemplated, such as those detailed below with respect to FIGS. 3A and 3B.

Handles 210, 220 may be made from a nylon webbing with UV treatment. Alternatively, handles 210, 220 may be made from polypropylene webbing, polyester webbing, or leather. These materials are advantageous in that they are strong, durable, weather-proof, water and mildew resistant, easy to clean, non-water absorbent, and resist UV-degradation. Further, by forming handles 210, 220 from such materials, handles 210, 220 are floppy, so as not to interfere with lifting, throwing, dropping, or otherwise manipulating fitness training bag 10 when not being grasped by handles 210, 220.

Figure 3A:
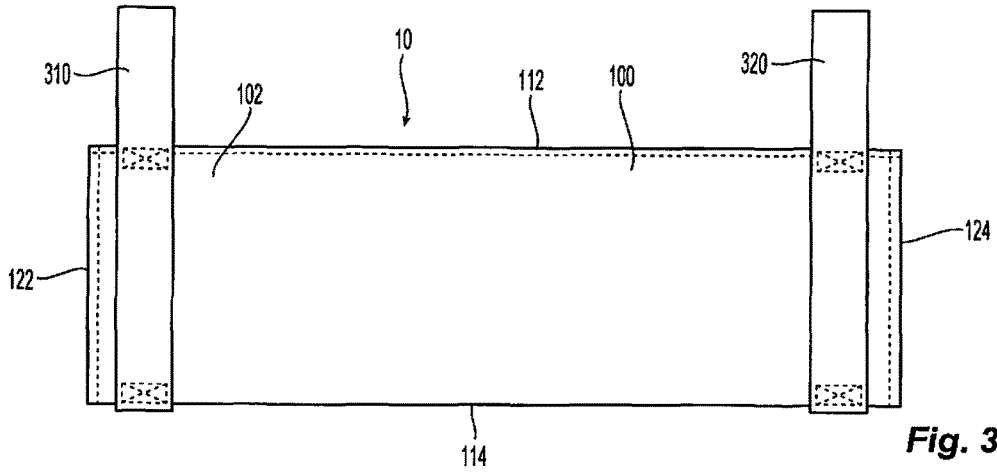
FIG. 3A is a side view of the fitness training bag of FIG. 1 including another configuration of handles.

Turning now to FIG. 3A, in another embodiment of the fitness training bag 10, handles 310, 320 extend around the outer peripheral circumference of outer bag 102 of body 100. Handles 310, 320 are secured about body 100 via reinforced stitching at various locations around the peripheral circumference of outer bag 102 of body 100 and extend from upper portion 112 thereof to define looped portions 312, 322 of handles 310, 320, respectively. As can be appreciated, having handles 310, 320 extend around the outer peripheral circumference of outer bag 102 of body 100 provides greater strength to the engagement between handles 310, 320 and outer bag 102. Handles 310, 320 may otherwise be configured similar to handles 210, 220, detailed above with respect to FIGS. 1 and 2.

Figure 3B:
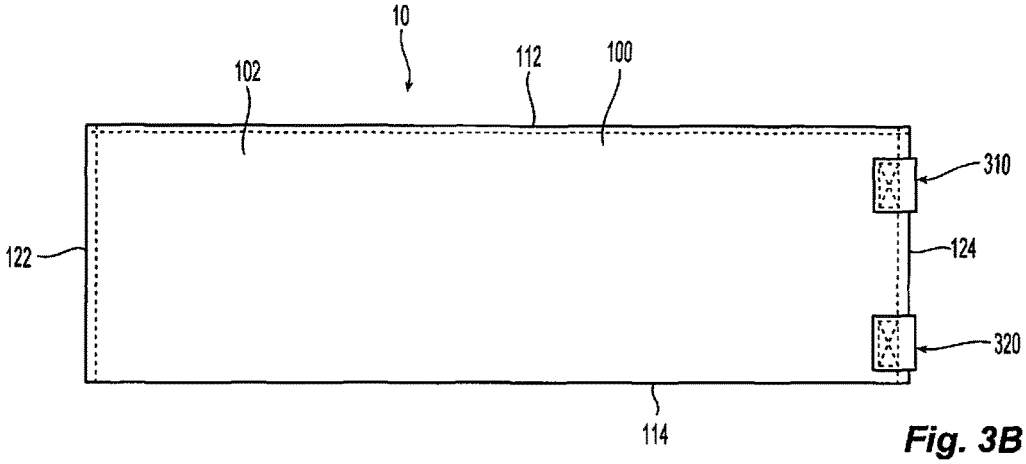
FIG. 3B is a side view of the fitness training bag of FIG. including another configuration of handles.

With reference to FIG. 3B, in another embodiment of the fitness training bag 10, handles 410, 420 are engaged to one of the end portions 122, 124 of body 100, e.g., end portion 124, although handles 410, 420 engaged to both end portions 122, 124 are also contemplated. In the embodiment of FIG. 3B, handles 410, 420 are configured as low-profile straps wherein the ends thereof are secured to outer bag 102 of body 100 of fitness training bag 10 at spaced-apart positions along end portion 124 thereof (as an alternative to the looped configurations of handles 210, 220 which are secured together to outer bag 102 (FIGS. 1 and 2)). In use, a user can grasp the free, central portion of either or both of handles 410, 420 to enable manipulation of training bag 10. As an alternative to strap-style handles, handles 410, 420 may be configured as loop handles such as those detailed above with respect to handles 210, 220, and vice versa; or both loop and strap-style handles may be provided. The length of handles 210, 220 may each be between 6 and 20 inches.

Figure 3C:
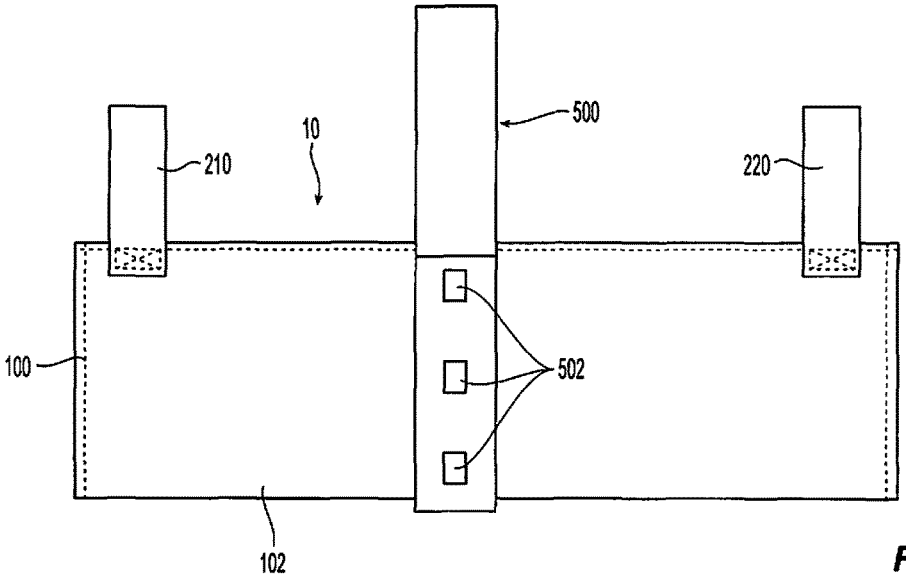
FIG. 3C is a side view of the fitness training bag of FIG. 1 including a releasable handle engaged therewith.

Turning to FIG. 3C, fitness training bag 10 may further be configured for use with one or more removable handles 500. Removable handle 500 is configured to extend about the peripheral circumference of outer bag 102 of body 100 and may be secured in position via one or more releasable securement members 502, e.g., buttons, snaps, hook and latch engagements, buckles, etc. Depending upon the exercise to be performed, the number and/or positioning of removable handle 500 may be altered to define a desired configuration. For example, it is contemplated that removable handle 500 may be selectively positioned anywhere on the bag depending upon a person's size or a particular exercise routine. Moreover, personal removable handles may be separately manufactured for use with different bags. As can be appreciated this has tremendous benefits over other known bags since a user can use his or her own handles 500 for each bag and for each exercise eliminating obvious health concerns with multiple users of gym equipment (hygiene, bacteria, etc.).

Removable handles 500 by be secured by the user in any known fashion at specific location (e.g., snap fit) or may be slidingly secured to allow the user to move the handles 500 along any side of the outer bag 102. Handles 500 may be easily removed and re-attached as needed. Handles 500 may also be easily sterilized or washed after each use.

Figure 3D:
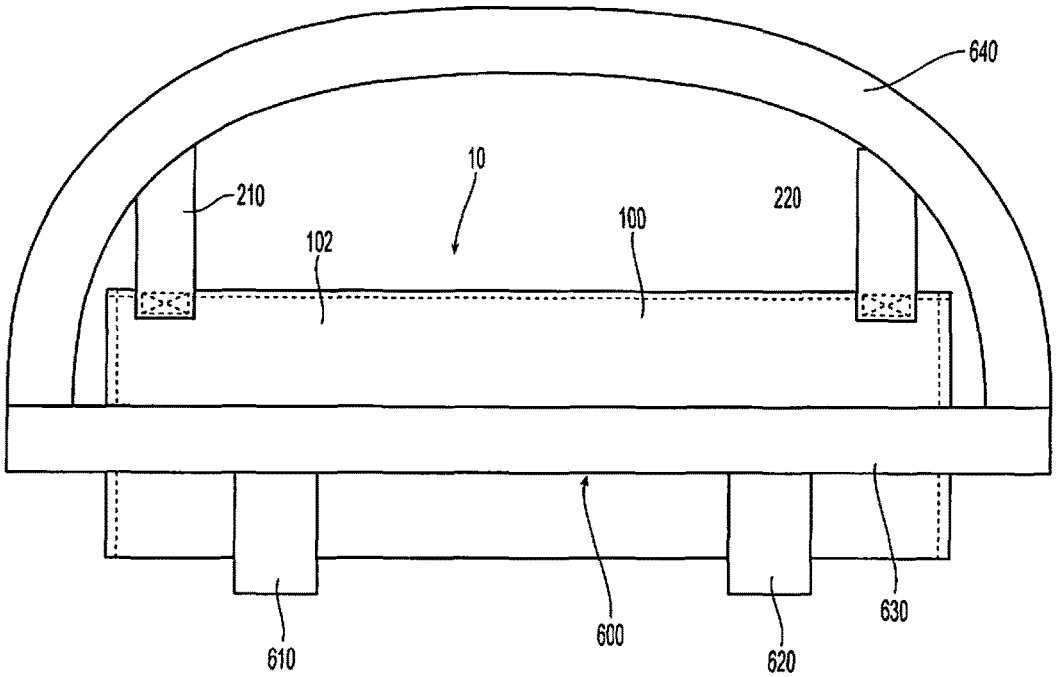
FIG. 3D is a side view of the fitness training bag of FIG. 1 including a carrying harness engaged therewith.

As shown in FIG. 3D, fitness training bag 10 may include a carrying harness 600 facilitating transport of fitness training bag 10. Carrying harness 600 includes a pair of semi-annular strap portions 610, 620 configured to extend semi-annularly about the circumference of body 100 of fitness training bag 10 adjacent lower portion 114 thereof, a long strap portion 630 configured to extend longitudinally about body 100 of fitness training bag 10, and a carrying strap portion 640 extending from long strap portion 630 adjacent each end portion 122, 124 of body 100 of fitness training bag 10. As can be appreciated, carrying harness 600 can be readily slipped into position about body 100 of fitness training bag 10. Once carrying harness 600 is disposed about body 100 of fitness training bag 10, carrying strap portion 640 may be utilized to facilitate transport thereof. Other suitable configurations of carrying harnesses are also contemplated.

Figure 3E:
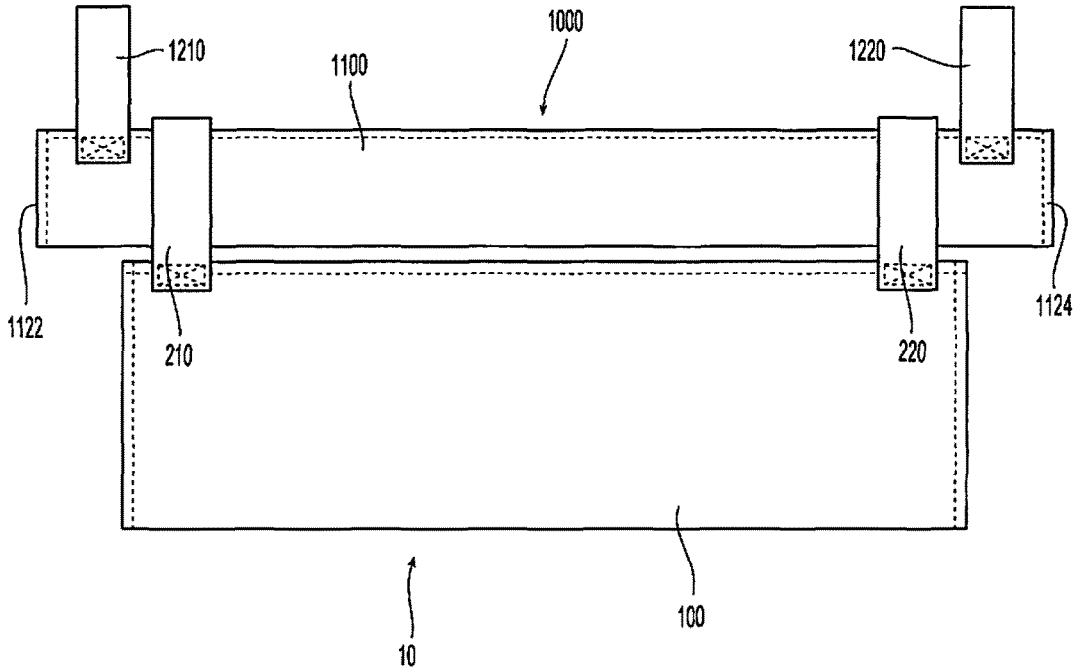
FIG. 3E is a side view of the fitness training bag of FIG. 1 supporting another fitness training bag for tandem use.

Referring to FIG. 3E, as noted above, in some embodiments, openings 214, 224 defined through handles 210, 220 are configured to enable receipt of the opposed end portions 1122, 1124 of body 1100 of another fitness training bag 1000 to enable tandem use thereof. As illustrated in FIG. 3E, fitness training bag 1000 is manipulated relative to fitness training bag 10 such that handles 1210, 1220 of fitness training bag 1000 are disposed outwardly of handles 210, 220 of fitness training bag 10. In this configuration, grasping handles 1210, 1220 during use helps ensure that body 1100 of fitness training bag 1000 remains disposed within openings 214, 224 defined through handles 210, 220 of fitness training bag 10 and, thus, that bags 10, 1000 remain coupled to one another during tandem use. However, other configurations are also contemplated.

Figure 3F:
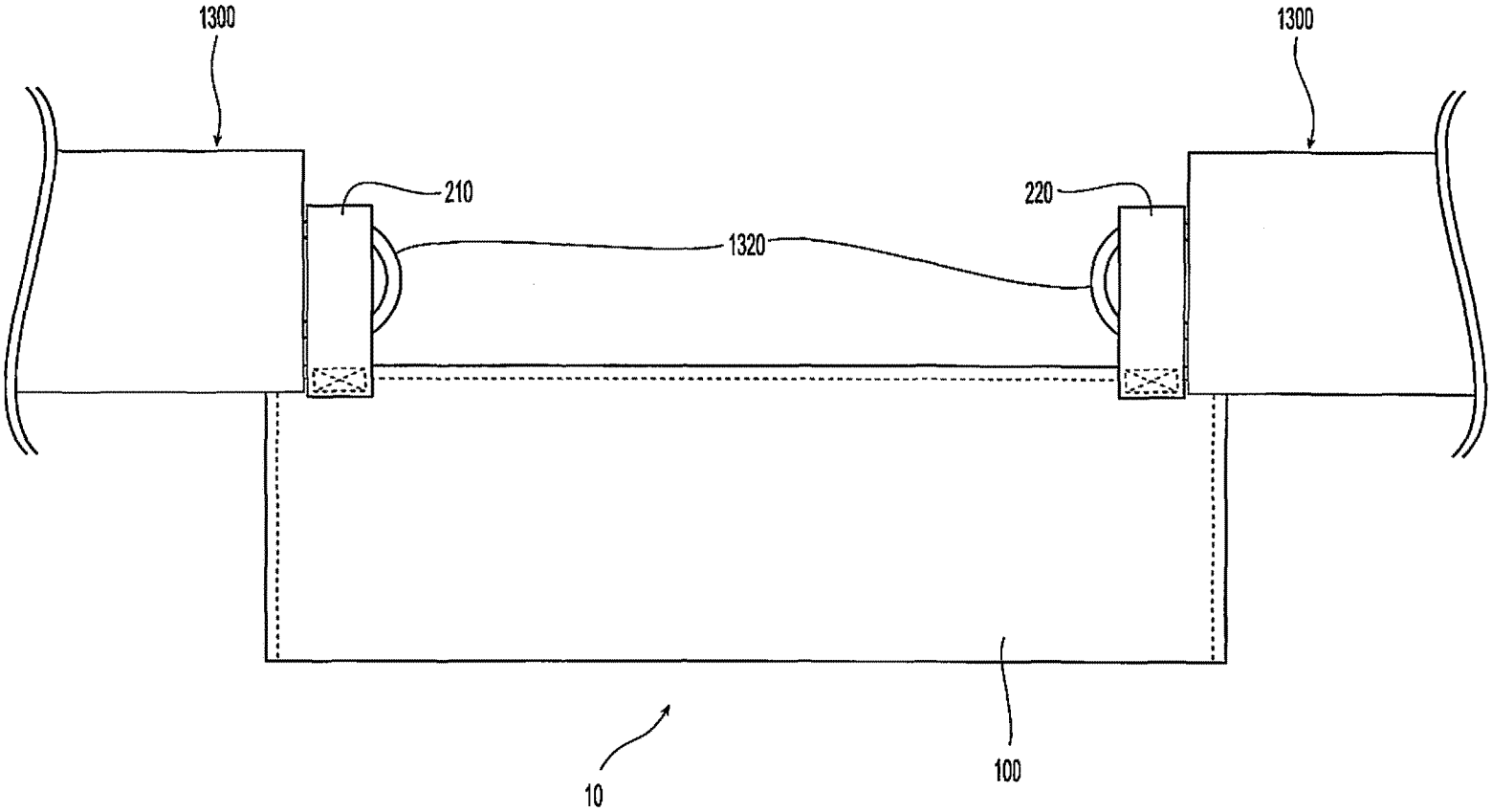
FIG. 3F is a side view of the fitness training bag of FIG. 1 supporting a pair of other fitness training bags for multi-bag use.

With reference to FIG. 3F, another configuration of multi-bag use is detailed. More specifically, a pair of fitness training bags 1300 are positioned such that the handle(s) 1320 of each fitness training bag 1300 extends through one of the openings 214, 224 defined through handles 210, 220 of fitness training bag 10. In this configuration, grasping handles 1320 of fitness training bags 1300 during use retains handles 210, 220 of fitness training bag 10 between the user's hands and body 1310 of fitness training bag 1300, thus helping to ensure that fitness training bags 1300 and fitness training bag 10 remain coupled to one another during use. Fitness training bags 1300 may be configured similar to the fitness training bag 10 illustrated in and described with respect to FIG. 3A, may be configured similar to any of the other fitness training bags detailed herein, or may define any other suitable configuration.

Figure 4A:
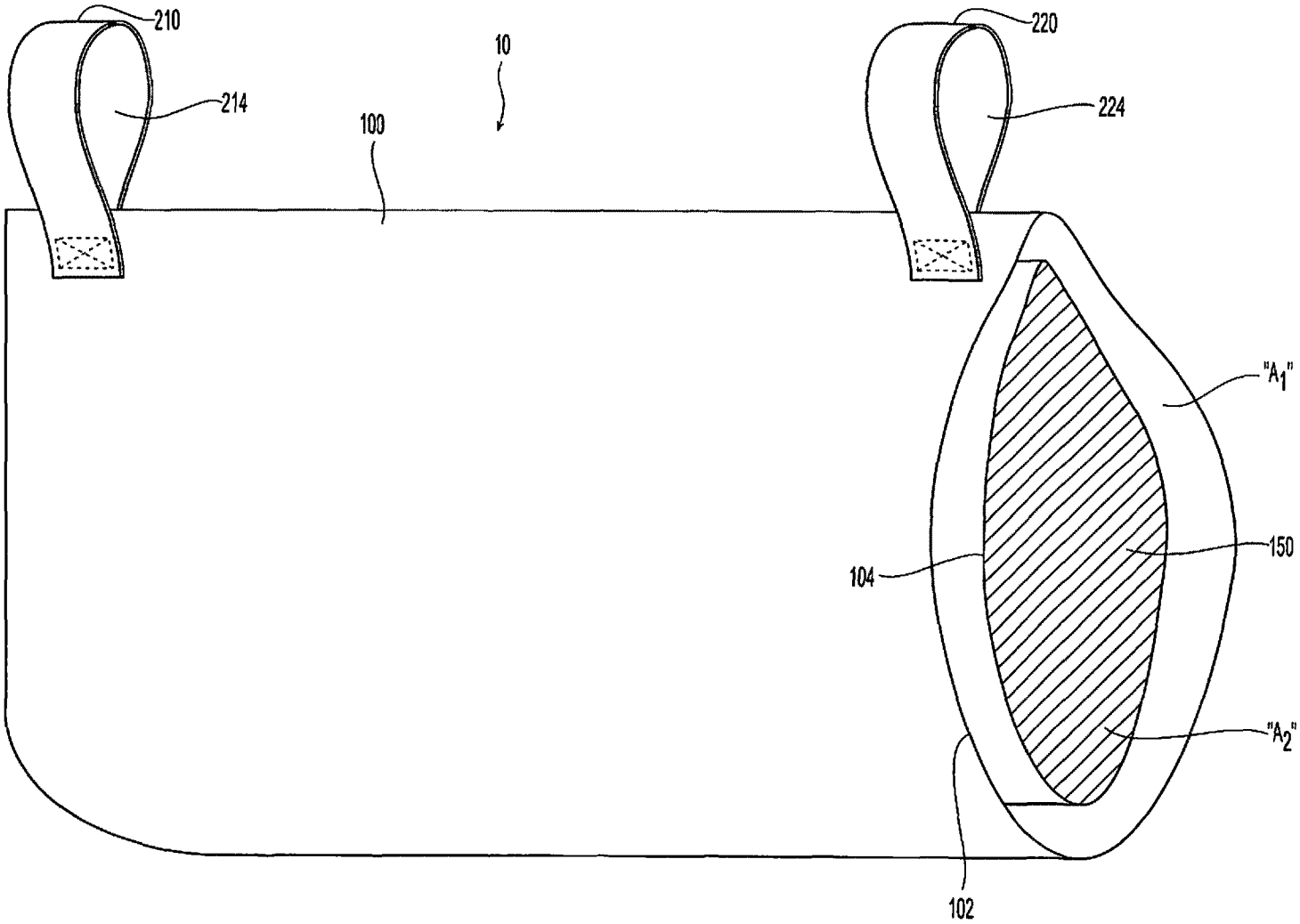
FIG. 4A is a perspective, partial cross-sectional view of the fitness training bag of FIG. 1 illustrating the internal configuration thereof.

Turning to FIG. 4A, as noted above, body 100 of fitness training bag 10 includes an outer bag 102 that fully encloses an interior area "$A_1$" therein. Disposed within the interior area "$A_1$" of outer bag 102 is an inner bag 104. Inner bag 104 may be formed from a non-woven polypropylene or polyethylene material having a fabric weight of between 8 ounces and 10 ounces. Other materials for forming inner bag 104 are also contemplated, as are other fabric weights thereof, e.g., between 2 ounces and 14 ounces.

Inner bag 104 fully encloses an interior area "$A_2$" therein for retaining a filler 150 within inner bag 104. More specifically, inner bag 104 may be formed in a similar manner as detailed above with respect to outer bag 102, although other manufacturing techniques are also contemplated. The above-detailed materials forming and configuration of inner bag 104 is such that inner bag 104 allows for drainage, is sufficiently dense to inhibit leakage of the filler 150 therefor, and provides a relatively high tensile strangle to inhibit ripping, tearing, or otherwise damaging inner bag 104.

Filler 150 is a composition of individual pieces of material that cooperate to form a filler 150 that is non-absorbent, drainable, non-packable, resiliently compressible, inert to insects and animals, and durable. A non-absorbent, drainable filler 150 allows for fitness training bag 10 to be utilized in adverse weather conditions without the worry of altering the weight of fitness training bag 10 or damaging fitness training bag 10, e.g., via mildew or mold growth. A non-packable, resiliently compressible filler 150 provides flexibility to fitness training bag 10 and allows for some "bounce," thus making fitness training bag 10 more comfortable, manipulatable, and cushioning (shock-absorbing).

In order to achieve the above-noted properties, filler 150 may include a composition of individual pieces of chopped and/or crushed rubber sized in the range of 1/32 inches to 1 inch. In some embodiments, to facilitate environmental friendliness, the rubber is scrap material from the manufacture of molded shoe soles, such as those sold under the trademark Vibram® and produced by Quabaug Corporation of North Brookfield, Mass., USA. However it is additionally or alternatively envisioned that filler 150 may be made from scrap and/or recycled material from other rubber sole manufactures and/or other products such as, for example, tires, plastic pellets, pea-stone, steel shot, and combinations thereof. In embodiments, the filler 150 is a mixture of rubber sole scrap material of different densities, e.g., three different densities corresponding to three different types of rubber soles, although material of uniform density may also be utilized.

To achieve a desired weight of fitness training bag 10, as can be appreciated, the composition thereof may be altered, e.g., via using different materials (such as those detailed above) or mixtures thereof. For example, where a heavier bag 10 is desired, filler 150 may include a mixture of rubber sole scrap and plastic pellets having a specific gravity between 1.0 and 1.8. Such plastic pellets may be talc filled polyethylene and/or talc filled polypropylene pellets, although other suitable materials are also contemplated.

Additionally or alternatively, a desired weight of fitness training bag 10 may be achieved by altering the amount of filler 150 utilized. It is envisioned that inner bag 104 be selected such that the interior area "$A_2$" thereof is suitable for retaining the desired amount of filler 150 at 75% to 100% capacity by volume to inhibit large shifts in the filler 150 within inner bag 104 during use, although other fill percentages are also contemplated. Likewise, outer bag 102 is only slightly larger than inner bag 104 so as to inhibit substantial shifting or movement of inner bag 104 during manipulation of fitness training bag 10. Inner bag 104 may further be sewn to outer bag 102 to retain the position thereof.

Figure 4B:
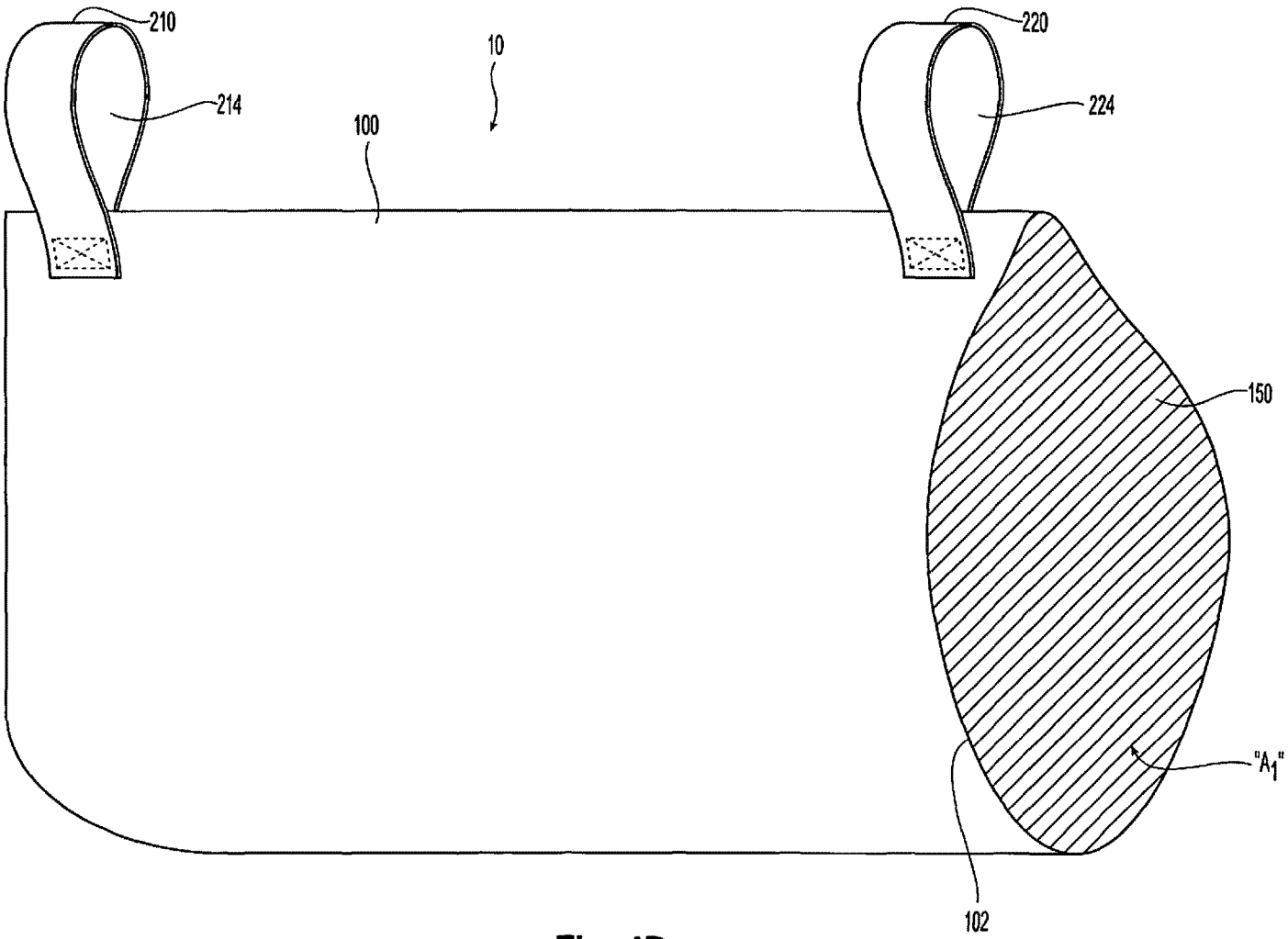
FIG. 4B is a perspective, partial cross-sectional view of another fitness training bag similar to the fitness training bag of FIG. 1 except for the internal configuration thereof.

Referring to FIG. 4B, in other embodiments, inner bag 104 (FIG. 4A) is eliminated and filler 150 occupies interior area "$A_1$" of outer bag 102. In such embodiments, the material forming outer bag 102 is selected to be sufficiently-tightly woven so as to inhibit the escape of filler 150 therethrough. Alternatively, inner bag 104 (FIG. 4A) may still be provided and the interior area "$A_2$" thereof retaining a first filler 150, while the interior area "$A_1$" of outer bag 102 that surrounds inner bag 104 (FIG. 4A) retains a second filler 150 therebetween. First and second fillers 150 may be similar or different, and may be formed, sized, and/or configured in any of the manners detailed above.

Figure 4C:
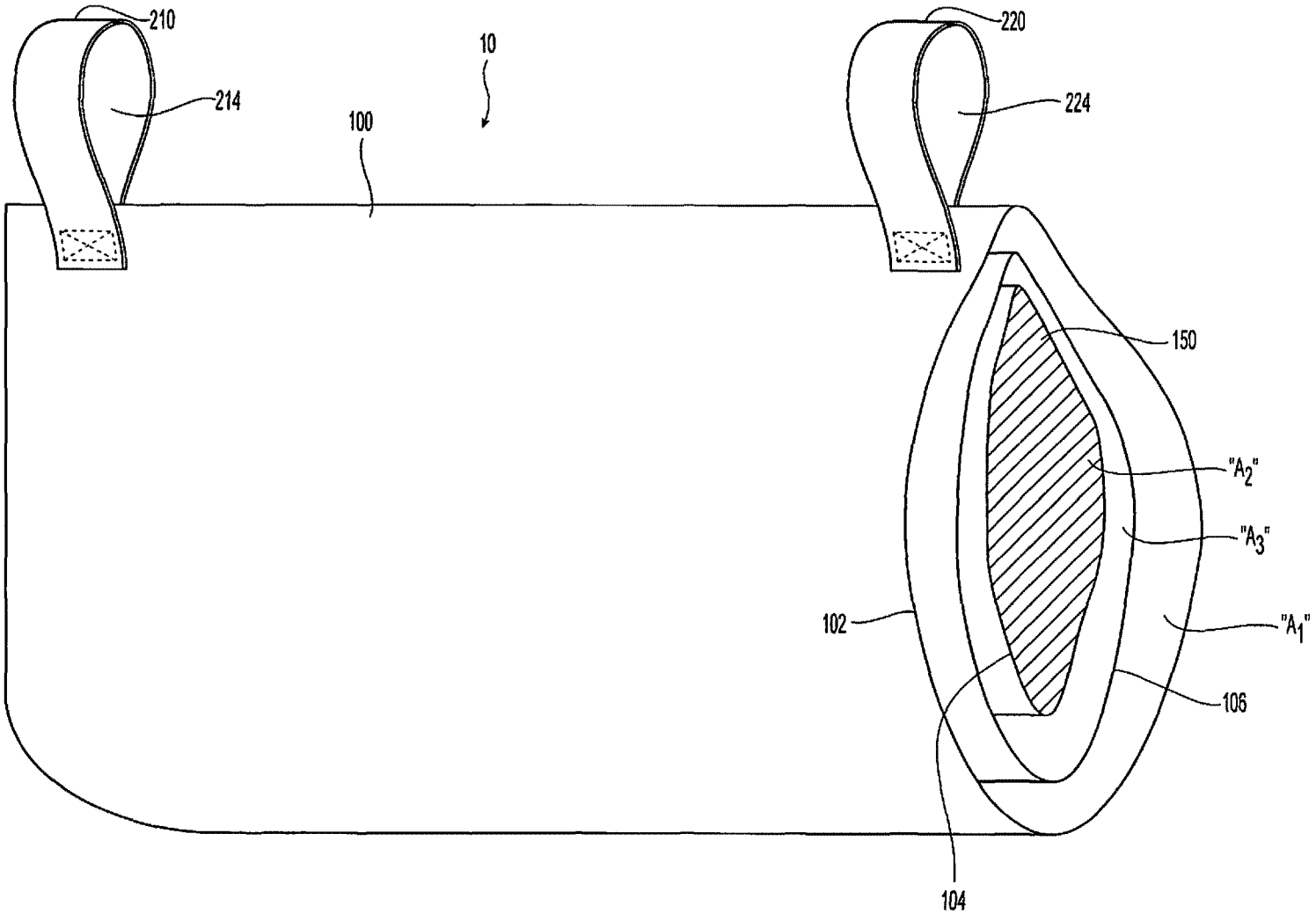
FIG. 4C is a perspective, partial cross-sectional view of another fitness training bag similar to the fitness training bag of FIG. 1 except for the internal configuration thereof.

Referring to FIG. 4C, in still other embodiments, an intermediate bag 106 is provided between outer bag 102 and inner bag 104. Intermediate bag 106 may be formed in a similar manner as detailed above with respect to outer bag 102, although other manufacturing techniques are also contemplated. Intermediate bag 106 may be formed from a non-woven polypropylene or other material and is configured to serve as an additional cushioning layer. Intermediate bag 106 may be sewn about its perimeter to outer bag 102, inner bag 104, or may be free-floating therebetween. Intermediate bag 106 defines an interior area "$A_3$" that may be filled with a third filler 150 (with or without interior area "$A_1$" of outer bag 102 including second filler 150 disposed therein).

From the foregoing and with reference to the various figure drawings, those skilled in the art will appreciate that certain modifications can also be made to the present disclosure without departing from the scope of the same. While several embodiments of the disclosure have been shown in the drawings, it is not intended that the disclosure be limited thereto, as it is intended that the disclosure be as broad in scope as the art will allow and that the specification be read likewise.

For example, it is contemplated that the bag may be utilized without handles for a particular purpose and to perform a particular exercise. In one instance the handles 500 are removed (e.g., removable handles) and a particular type of exercise is performed. In one embodiment, the bag may be constructed without handles 500 and simply used in this fashion. In another contemplated embodiment, the inner bag 104, outer bag 106 or intermediate bag 106 may be filled with only one material (e.g., one type of filler) or one or more materials with the same density depending upon a particular purpose.

Therefore, the above description should not be construed as limiting, but merely as exemplifications of particular embodiments. Those skilled in the art will envision other modifications within the scope and spirit of the claims appended hereto.

What is claimed is:

1. A fitness training bag, comprising:

a body, including:

an outer bag enclosing a first interior area therein, the outer bag being water-permeable;

an inner bag disposed within the first interior area, the inner bag enclosing a second interior area therein, the inner bag being water-permeable; and a filler disposed within the second interior area, the filler including a plurality of pieces of material, the plurality of pieces of material being non-absorbent, drainable, and non-packable, at least some of the plurality of pieces of material being resiliently compressible so as to be shock-absorbing; and at least one handle stitched to the body, the at least one handle configured to facilitate manipulation of the body to perform an exercise.

2. The fitness training bag according to claim 1, wherein the outer bag is formed from a woven polyethylene cloth.

3. The fitness training bag according to claim 1, wherein the inner bag is formed from a non-woven polypropylene or polyethylene material.

4. The fitness training bag according to claim 1, wherein the filler is formed from pieces of rubber.

5. The fitness training bag according to claim 4, wherein the pieces of rubber are recycled scrap material from other manufacturing processes.

6. The fitness training bag according to claim 4, wherein at least some of the pieces of rubber define different densities.

7. The fitness training bag according to claim 1, wherein the filler is formed from pieces of rubber mixed with plastic pellets.

8. The fitness training bag according to claim 1, wherein the at least one handle includes a first handle and a second handle, the first and second handles stitched to the body, the first and second handles spaced-apart along the body a distance between 16 inches and 36 inches.

9. The fitness training bag according to claim 8, wherein the first and second handles are spaced-apart along the body a distance between 22 and 30 inches.

10. The fitness training bag according to claim 8, wherein the first and second handles are spaced-apart along the body a distance of 26 inches.

11. The fitness training bag according to claim 1, wherein the at least one handle defines a looped configuration having an aperture of between 3 and 9 inches in diameter.

12. The fitness training bag according to claim 1, wherein the at least one handle includes first and second ends stitched to the body at spaced-apart positions along the body.

13. The fitness training bag according to claim 1, further including an intermediate bag disposed between the inner and outer bags, the intermediate bag configured to provide additional cushioning to the body.

14. A fitness training set, comprising:

a plurality of fitness training bags, each fitness training bag including:

a body, including:

an outer bag enclosing a first interior area therein, the outer bag being water-permeable;

an inner bag disposed within the first interior area, the inner bag enclosing a second interior area therein, the inner bag being water-permeable; and a filler disposed within the second interior area, the filler including a plurality of pieces of material, the plurality of pieces of material being non-absorbent, drainable, and non-packable, at least some of the plurality of pieces of material being resiliently compressible so as to be shock-absorbing; and at least one handle stitched to the body, the at least one handle configured to facilitate manipulation of the body to perform an exercise, wherein each of the fitness training bags includes at least one of a different filler or a different amount of filler such that each of the fitness training bags defines a different weight.

15. The fitness training set according to claim 14, wherein two of the fitness training bags are configured for use in tandem with one another.

16. The fitness training set according to claim 14, wherein the outer bag is formed from a woven polyethylene cloth and the inner bag is formed from a non-woven polypropylene or polyethylene material.

17. The fitness training set according to claim 14, wherein the filler of each of the fitness training bags is recycled scrap material from other manufacturing processes.

18. The fitness training set according to claim 14, wherein at least some of the pieces of material forming the filler define different densities.

19. The fitness training set according to claim 14, wherein the pieces of material forming filter include at least two different materials.

20. The fitness training set according to claim 14, wherein the at least one handle of at least one of the fitness training bags includes a first handle and a second handle, the first and second handles spaced-apart along the body a distance between 16 and 36 inches.

* * * * *